US006281174B1

(12) United States Patent
Haruna

(10) Patent No.: US 6,281,174 B1
(45) Date of Patent: Aug. 28, 2001

(54) METHOD TO IMPROVE CU CORROSION PERFORMANCE OF MO-DTC AND ACTIVE SULFUR BY ADDING SUNFLOWER OIL

(75) Inventor: Junsuke Haruna, Tokai (JP)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 09/030,381

(22) Filed: Feb. 25, 1998

(30) Foreign Application Priority Data

Oct. 30, 1997 (JP) ..... 9-298940

(51) Int. Cl.[7] ..... C10M 141/08; C10M 141/12
(52) U.S. Cl. ..... 508/322; 508/363; 508/364
(58) Field of Search ..... 508/322, 363, 508/364

(56) References Cited

U.S. PATENT DOCUMENTS

| | | | | |
|---|---|---|---|---|
| 3,372,116 | | 3/1968 | Meinhardt | 252/36 |
| 3,410,798 | | 11/1968 | Cohen | 252/37.2 |
| 4,098,705 | | 7/1978 | Sakurai et al. | 252/33.6 |
| 4,289,635 | | 9/1981 | Schroeck | 252/32.7 |
| 4,612,129 | * | 9/1986 | DiBease et al. | 508/328 |
| 4,623,473 | | 11/1986 | Davis et al. | 252/33.6 |
| 4,740,322 | | 4/1988 | Dibiase et al. | 252/47.5 |
| 4,758,362 | | 7/1988 | Butke | 252/47.5 |
| 5,207,936 | * | 5/1993 | Anzai et al. | 508/363 |
| 5,328,620 | | 7/1994 | Ripple | 252/32.7 |
| 5,498,355 | * | 3/1996 | Perozzi et al. | 508/437 |
| 5,627,146 | | 5/1997 | Tanaka et al. | 508/363 |

FOREIGN PATENT DOCUMENTS

| | | | |
|---|---|---|---|
| 0725130A2 | 8/1996 | (EP) | 169/4 |
| WO96/06904 | 3/1996 | (WO) | 141/10 |
| WO96/23856 | 8/1996 | (WO) | 169/4 |

OTHER PUBLICATIONS

Japanese Patent Laid–Open Application No. 56202/1973 Abstract.
Japanese Patent Laid–Open Application No. 62–81396/1987 Abstract.
Japanese Patent Laid–Open Application No. 5–279686/1993 Abstract.
Japanese Patent Laid–Open Application No. 5–230485/1993 Abstract.
Japanese Patent Laid–Open Application No. 5–186787/1993 Abstract.
Japanese Patent Laid–Open Application No. 5–163497/1993 Abstract.

* cited by examiner

*Primary Examiner*—Jacqueline V. Howard
(74) *Attorney, Agent, or Firm*—William J Connors

(57) ABSTRACT

Lubricating compositions are described which contain organomolybdenum compounds and sulfur compounds (donors). The copper corrosion of said compositions is reduced by reacting the sulfur donors with plant oils to reduce sulfur activity and thus copper corrosion prior to the sulfur donors being added to the majority of oil to form a lubricating composition.

8 Claims, 3 Drawing Sheets

METHOD TO IMPROVE CU CORROSION PERFORMANCE OF MO-DTC AND ACTIVE SULFUR BY ADDING SUNFLOWER OIL

FIELD OF INVENTION

The present invention relates to novel lubricating compositions containing molybdenum which exhibit reduced copper corrosion activity. The compositions comprise organomolybdenum compounds and a sulfur donor compound which has been treated with a plant oil to remove active sulfur. The molybdenum compounds used are dithiocarbamates in various forms.

BACKGROUND OF THE INVENTION

It is by now well known to use organomolybdenum compounds in lubricating oil compositions to decrease friction between moving parts. In oils used to lubricate internal combustion engines lowering of friction between moving parts increases fuel efficiency. As well as oils for internal combustion engines, organomolybdenum compounds may also be used in functional fluids such as manual and automatic transmission fluids, wet brakes fluids, hydraulic fluids and other comparable fluids.

The organomolybdenum compounds used in lubricating compositions are molybdenum containing alkyl and dialkyl dithiocarbamates and their oxyo and/or sulfurized analogs. Examples of such organomolybdenum compounds are disclosed in the following patent publications, all of which are incorporated herein by reference.

Japanese Patent Laid-Open Application No. 56202/1973 teaches a compound having the general formula $[R_2N—CS_2]_2—Mo_2S_4$ wherein R is an alkyl group, which compound is useful as an additive for lubricants. But that compound has a corrosive action on copper-containing materials, so the use of that compound has been limited.

Japanese Patent Laid-Open No. 62-81396, for example, proposes a molybdenum-containing lubricant additive with an excellent oxidation preventive function, wear proofing function, friction mitigating function and metal corrosion inhibiting function, and further is highly soluble in a base oil such as mineral oil. Japanese Patent Laid-Open No. 48-56202 proposes an extreme pressure lubricant containing MoDTC blended thereto.

Further, Japanese Patent Laid-Open No. 5-279686 proposes a lubricating oil composition for an internal combustion engine prepared by blending (a) sulfurized oxymolybdenum dithiocarbamate and/or sulfurized oxymolybdenum organophosphorodithioate, (b) fatty acid ester and/or organoamide compound, (c) at least one compound selected from the group consisting of calcium sulfonate, magnesium sulfonate, calcium phenate and magnesium phenate, (d) at least one compound selected from the group consisting of benzylamine and boron derivatives of benzylamine, and (e) zinc dithiophosphate and/or zinc dithiocarbamate, in a base oil for a lubricating oil.

Japanese Patent Laid-Open No. 5-230485 proposes a lubricating oil composition for an engine oil containing, as essential components in a base oil using a mineral oil and/or a synthetic lubricating oil, (a) an alkaline earth metal salt of alkyl-salicylic acid, (b) a bis-type alkenylsuccinic acid imide having a polybutenyl group and/or its derivative, and (c) sulfurized oxymolybdenum organophosphorodithioate and/or molybdenum dithiocarbamate.

Japanese Patent Laid-Open No. 5-186787 proposes a lubricating oil composition prepared by blending (a) sulfurized oxymolybdenum dithiocarbamate and/or sulfurized oxymolybdenum organophosphorodithioate and (b) zinc dithiophosphate and/or zinc dithiocarbamate into a mineral oil, and further proposes a lubricating oil composition prepared by adding (c) an organic amide compound to the above.

Japanese Patent Laid-Open No. 5-163497 proposes an engine oil composition comprising (A) a base oil consisting of a mineral oil and/or a synthetic oil, (B) a boron compound derivative of alkenylsuccinic acid amide, (C) an alkaline earth metal salt of salicylic acid and (D) molybdenum dithiophosphate and/or molybdenum dithiocarbamate, as the principal components.

A molybdenum dihydrocarbyldithiocarbamate compound useful as an additive for lubricants is disclosed in U.S. Pat. No. 4,098,705 to Sakurai et al.

Novel sulfur and phosphorus containing molybdenum compositions which are useful for improving fuel economy for internal combustion engines are disclosed in U.S. Pat. No. 4,289,635 to Schroeck.

U.S. patent to NTN Corporation of Japan recites a grease composition for constant velocity joints comprising a urea grease including a lubricating oil and a urea base thickener and containing (A) 1–5% by weight of molybdenum sulfide dialkyldithiocarbamate, (B) 0.2–1% by weight of molybdenum disulfide, (C) 0.5–3% by weight of an extreme pressure additive of zinc dithiophosphate and (D) 0.5–5% by weight of an oiliness agent composed of at least one of vegetable oils and fats as an essential component, provided that a weight ratio of the component (B) to the component (A) is 0.04–0.5.

The instant invention does not contain a urea base thickener or molybdenum disulfide.

U.S. Pat. No. 5,627,146 to Asaki Denka Kogyo describes alkyl group asymmetric molybdenum dithiocarbamate having increased oil solubility.

International patent application published under publication number WO 96/06904 to the Tonen Corporation describes a composition having good lubricity and comprising a major amount of a lubricant base oil, a basestock of lubricating viscosity, to which a minor amount of additives has been added. The additives comprise specific amounts of oxymolybdenum dithiocarbamate sulfide having specific alkyl groups, zinc dialkyldithiophosphate having specific alkyl groups, one or more specific sulfur containing compounds, an ashless dispersant and a boron containing additive which may be the ashless dispersant. In further aspects of the invention a metal detergent is used. Conveniently, the dispersant and boron are added as a borated succinimide.

The invention of WO 96/06904 is a lubricant composition comprising a major amount of a lubricant base oil having added thereto a minor amount of additives comprising (A) oxymolybdenum dithiocarbamate sulfide having alkyl groups with 8 to 18 carbon atoms, (B) zinc dialkyldithiophosphate having primary alkyl groups with 1 to 18 carbon atoms, (C) one or more additional peroxide decomposing sulfur compounds, (D) an ashless dispersant, and (E) a boron containing additive in an amount sufficient to provide at from 0.005 to 0.06% by weight boron to the finished lubricant wherein to the total weight of the composition, the molybdenum content from oxymolybdenum dithiocarbamate sulfide is at 200 to 2,000 ppm (ratio by weight); the phosphorus content from zinc dialkyldithiophosphate is at 0.02 to 0.15% by weight; and the sulfur content from the additional peroxide decomposing sulfur compound is at 0.02 to 0.30% by weight. Conveniently, the additional peroxide decomposing sulfur compound is selected from the group consisting of zinc dialkyldithiocarbamate, copper dialkyldithiocarbamate or nickel dialkyldithiocarbamate wherein the dialkyldithiocabamate has alkyl groups with 2 to 18 carbon atoms, bis(dialkyldithiocarbanoyl)disulfide having an alkyl group with 2 to 18 carbon atoms, disulfide having an alkyl group with 2 to 18 carbon atoms, disulfide having an allyl group, an alkylallyl group or an allylalkyl group with 6 to 18 carbon atoms, olefin sulfide, fish oil sulfide, whale oil sulfide and mixtures of any of the foregoing.

WO 96/06904 describes in detail the use of additional sulfur compounds in the compositions described.

The additional sulfur compound required by WO 96/06904 is selected from any of the sulfur compounds that efficiently decompose peroxides. Without intending to be bound by any theory, the extended fuel economy performance of the present invention may be attributable to suppressed consumption of the oxymolybdenum dithiocarbamate sulfide and the zinc dialkyldithiophosphate because the sulfur compounds efficiently decompose peroxides.

As the dialkyldithiocarbamate salt to be blended in the lubricant composition of the invention, use is made of a compound represented by the general formula (3)

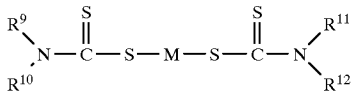

(3)

wherein M represents zinc, copper or nickel; $R^9$, $R^{10}$, $R^{11}$ and $R^{12}$ may be the same or different, each representing an alkyl group with 2 to 18 carbon atoms. Metal salts of dialkyldithiocarbamic acid are well known and readily available. Processes for their synthesis are described in U.S. Pat. Nos. 4,623,473 and 4,740,322.

The alkyl group of 2–18 carbon atoms represented by $R^9$, $R^{10}$, $R^{11}$ and $R^{12}$ in the general formula (3) may be linear or branched, including for example, an ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group and octadecyl group.

As the bis(dialkyldithiocarbamoyl)disulfide to be blended in the lubricant composition of the present invention, use may be made of a compound represented by the general formula (4):

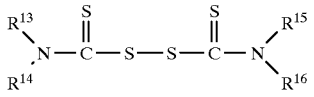

(4)

wherein $R^{13}$, $R^{14}$, $R^{15}$ and $R^{16}$ may be the same or different, each representing an alkyl group with 2 to 18 carbon atoms. The alkyl group of 2–8 carbon atoms represented by $R^{13}$, $R^{14}$, $R^{15}$ and $R^{16}$ in the general formula (4) may be linear or branched, including for example an ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group and octadecyl group.

As the disulfide to be blended in the lubricant composition of the invention, use is made of a compound represented by the general formula (5):

$$R^{17}—S—S—R^{18} \quad (5)$$

wherein $R^{17}$ and $R^{18}$ may be the same or different, each representing an alkyl group with 2 to 18 carbon atoms or an allyl group, an alkylallyl group or an allylalkyl group, with 6 to 18 carbon atoms. The alkyl group of 2–8 carbon atoms represented by $R^{17}$ and $R^{18}$ in the general formula (5) may be linear or branched, including for example an ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group and octadecyl group; the allyl group, the alkylallyl group or the allylalkyl group, having 6 to 18 carbon atoms and being represented by $R^{17}$ and $R^{18}$, includes for example a phenyl group, benzyl group, phenetyl group, methylbenzyl group, diphenylmethyl group and the like.

Olefin sulfide, fish oil sulfide and whale oil sulfide, to be blended with the lubricant composition of the invention, should be olefin sulfide (polysulfide) being produced by sulfide processing of polymers such as isobutylene and having a sulfur content of 25 to 40% by weight, fish oil sulfide and whale oil sulfide produced by processing individually fish oil and whale oil in the same manner.

European Patent Application EP 07251 30A2 to the Tonen Corporation describes a lubricating oil composition containing a majority of an oil of lubricating viscosity, a molybdenum dithiocarbamate, an organozinc compound, and a phenol based antioxidant.

Thus, it is known in the art to use organomolybdenum compounds to reduce frictional properties of lubricant oils and to use sulfur compounds as sulfur donors, as well as phenolic antioxidants, to suppress oxidative degradation of the organomolybdenum compounds.

SUMMARY OF THE INVENTION

In the instant invention the compositions and methods are provided for reducing copper corrosion problems of lubricating oils containing organomolybdenum compounds together with a sulfur containing compound. The sulfur containing compounds are those listed above in WO 96/06904, diaryl sulfides, sulfurized phenates as described in U.S. Pat. No. 5,328,620 which is herein incorporated by reference for disclosure of said sulfurized phenates. The sulfurized phenates are prepared from a phenol, elemental sulfur and a metal. Also included in the definition of sulfur compounds are carbamates as described in U.S. Pat. No. 4,758,362 which is herein incorporated by reference for said carbamate disclosure. Also included in the definition of sulfur containing compounds are metal disulfides of formula M-S—S-M where M is a metal.

It is thought that the sulfur compounds act as peroxide destroyers and that such peroxide destroyers degrade the molybdenum dithiocarbamates and thus shorten the useful life span or the friction reducing oils containing them.

While the addition of sulfur compounds to oils reduces degradation of the organomolybdenum compounds, said sulfur compounds cause increased copper corrosion properties of such oils. The copper corrosion results from unbound or active sulfur contained with said sulfur compounds.

We have discovered that in order to reduce copper corrosion properties of such oils, the sulfur compounds must be treated with compounds to reduce the active or non-bound sulfur of said sulfur compounds. Thus we have found that when copper corrosiveness of sulfur compounds for use in additive packages containing molybdenum dithiocarbamates and oxyo and sulfurized derivatives thereof are mixed with sunflower oil or other plant oil and heated prior to adding to said additive package, the copper corrosiveness of oils containing said additive packages is reduced. In theory the reduced copper corrosiveness is reduced because the unbound or active sulfur associated with said sulfur compounds is removed by reaction with the double bonds of the plant oils.

DETAILED DESCRIPTION OF THE INVENTION

Figure 1:
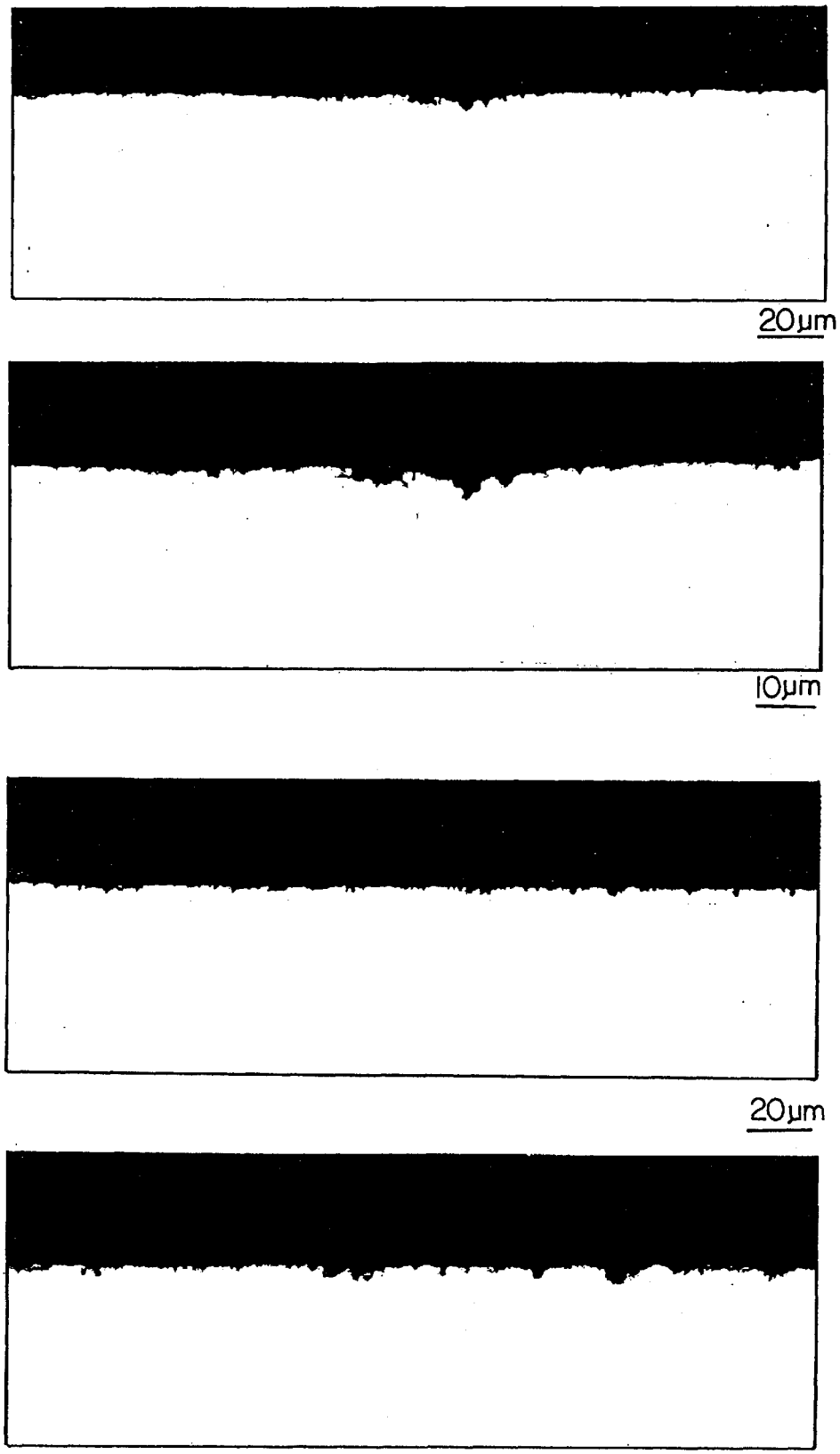
FIGS. 1 and 2 are drawings representing microscopic photographs of copper strips which demonstrate the efficacy of (FIG. 2) oil composition of the invention disclosed herein in reducing copper corrosion when compared with oils not included in this invention (FIG. 1).

The instant invention comprises an additive package for use in oils of lubricating viscosity to provide said oils containing said packages with improved frictional and reduced copper corrosion properties.

The additive package comprises a composition formed by mixing together:

A. a molybdenum dithiocarbamate;

B. a sulfur compound;

C. a plant oil;

wherein B. and C. are first mixed and heated together at time and temperature parameters to react unbound or active sulfur of B. with C. prior to mixing with A.

The additive package described above when mixed with an oil of lubricating viscosity provides for a lubricating composition having improved frictional properties and reduced copper corrosion activity. The lubricating oil composition comprises a lubricating composition formed by mixing:

A. a majority of an oil of lubricating viscosity;

B. a molybdenum dithiocarbamate;

C. a sulfur compound;

D. a plant oil;

wherein C and D are first mixed and heated together at time and temperature parameters to react unbound or active sulfur of C. and D. prior to mixing with A. and B.

The instant invention also provides a method for reducing copper corrosion in internal combustion engines. The method comprises adding to and operating said engine a lubricating oil composition comprising a mixture formed by mixing:

A. a majority of an oil of lubricating viscosity;

B. a molybdenum dithiocarbamate;

C. a sulfur compound;

D. a plant oil.

The molybdenum dithiocarbamate for use in this invention includes those incorporated by reference in the section above herein labeled "Background of the Invention".

The molybdenum dithiocarbamate compounds in addition to those described above include those disclosed in WO 96/23856, WO 96/06904 and EP 0725130. In general the molybdenum dithiocarbamates are alkyl and dialkyl dithiocarbamates and are available as Akeda S-100 from Asaki Denka Kogyo K.K., Tokyo 103 Japan and as various MOLYVAN® compositions from R. T. Vanderbilt Company of Norwalk, Conn., U.S.A..

Vanderbilt organomolybdenum dithiocarbamate compounds are MOLYVAN® A, a molybdenum oxysulfide dithiocarbamate of the formula:

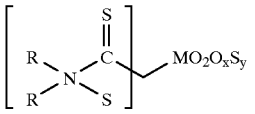

and MOLYVAN® 822 described by Vanderbilt as an organomolybdenum dithiocarbamate.

The sulfur compounds for use in the invention's compositions are those described hereinabove. The sulfur compounds act as sulfur donors and contribute to copper corrosion due to their unbound or active sulfur component. In preferred embodiments of the instant invention the sulfur compounds are dibenzyl disulfide, sulfurized phenols and phenates as described in U.S. Pat. Nos. 5,328,620; 3,372,116 and 3,410,798 and dithiocarbamate compounds described in U.S. Pat. No. 4,758,362. Preferred sulfur compounds are sulfur coupled dodecylphenol and its calcium overbased salt.

The plant oil with which the sulfur compound is mixed and heated for time and temperature parameters to reduce unbound or active sulfur is preferably sunflower oil but other plant oils with C═C unsaturation may also be used. The important requirement for the oils is that they contain C═C unsaturation with which sulfur can react. The ratio of sunflower oil (SFO) to sulfur compound depends on the activity of the sulfur in the sulfur compound. Usually a weight ratio of 5:1 to 1:1 for the weight ratio of SFO to sulfur compound is preferred but ratios of less than 1:1 and down to 0.5:1 by weight may also be used.

Prior to mixing with other components to form an additive package or containing said additive package the SFO and sulfur compound are mixed and heated under parameters by which the unbound or active sulfur of the sulfur compound reacts with unsaturated sights in the SFO. A preferred range of reaction time and temperature is about 3 hours at 90° C. but other suitable parameters can easily be decided upon.

EXAMPLES

In the following examples, the percents given are weight percent on an oil free basis for the weight of components based on the total weight of the oil composition except for the Akeda S-100 molybdenum dithiocarbamate compound which is used as purchased.

Oil A

A majority of a Tonen base oil and added thereto:

1. 3.05 weight percent $\overline{M}_n$ 2,000 ashless polyisobutylene/polyamine dispersant;
2. 0.36 weight percent zinc dithiophosphate di-2-ethylhexyl ester;
3. 0.58 weight percent zinc dithiophosphate isopropyl, methylamyl ester;
4. 1.34 weight percent calcium overbased sulfur coupled dodecyl phenol;

5. 1.2 weight percent Akeda S-100 molybdenum dithiocarbamate;
6. 4.0 weight percent $C_{12}$-isopropyl, diisobutylphenol.

Oil B

1. Oil A plus
2. 0.29 weight percent sulfur coupled dodecylphenol.

Oil C

1. Oil A
2. 0.58 weight percent sulfur coupled dodecylphenol

Oil D

1. Oil A
2. 1.0 weight percent sunflower oil

Oil E

1. Oil C
2. 1.0 weight percent sunflower oil

Oil F

1. Oil A
2. 0.2 weight percent dibutyldisulfide

Oil G

1. Oil F
2. 1.0 weight percent sunflower oil

In general, the range of weight percents of components in the total oil composition range from 1–10 weight percent polyisobutylene/polyamine dispersant and/or its borated derivative; 0.1–5 weight percent of a dihydrocarbon dithiophosphate where hydrocarbon is given an expansive reading; 0.1–7 weight percent of a sulfur coupled alkyl phenol and/or its calcium overbased salt, 0.1–5 weight percent of a molybdenum dithiocarbamate and 0.1–10 weight percent of an antioxidant.

For the oils above (A–G) copper strips were soaked in oil at 120° C. for 192 hours. An arbitrary rating of 1A–4A was ascribed to copper corrosion on the individual strips. 1A was judged to be the least corroded (least-darkened) and 4A the most corroded (most-darkened) value prescribed to the strips. Table 1 below shows the results.

TABLE 1

| Oil | A | B | C | D | E | F | G |
|---|---|---|---|---|---|---|---|
| Corrosion | 2A | 3A | 3A | 1A | 1A | 4A | 1A |

The results above clearly show that the addition of a sulfur donor causes copper corrosion when added to a molybdenum dithiocarbamate containing oil (Oils B, C, F) but the corrosion is negated when the sulfur donor is first heated with sunflower oil as described hereinabove and the SFO/sulfur compound then added to the oil additive mixture which is then added to the oil (Oils D, E, G).

Figure 2:
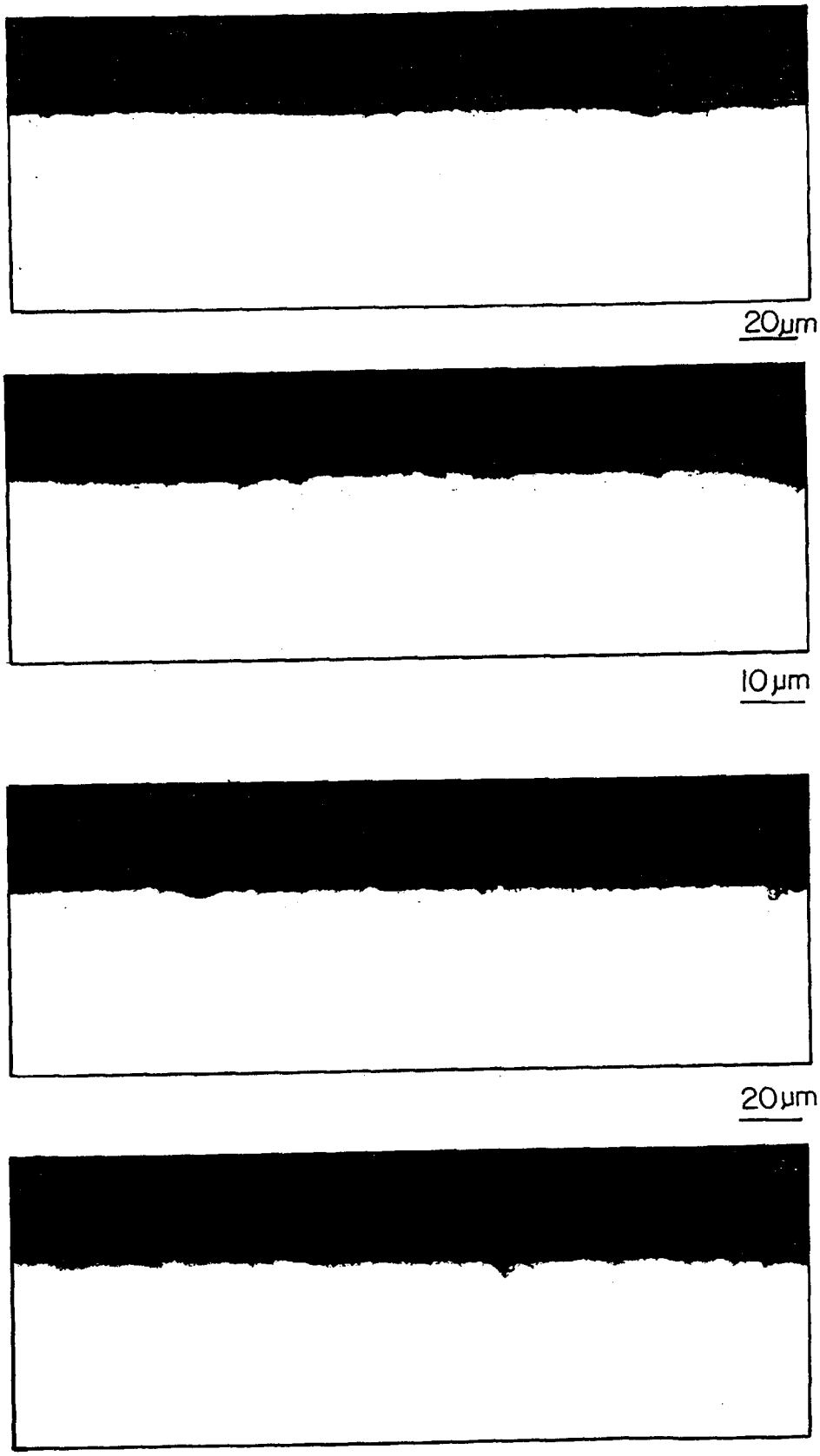

Copper strips used in the copper corrosion test for Oils C and E were examined in detail for the effects of copper corrosion and the chemical elements associated with said corrosion. In this a cross section of the copper plates used with Oils C and E were polished and examined microscopically. Drawings representing microscopic photographs of cross sections from copper plates are shown in FIGS. 1 and 2 for plates corroded respectively with Oil C and Oil E. The photos demonstrated conclusively that the corrosion caused by sulfur coupled dodecylphenol in Oil C is largely eliminated by first heating said phenol with SFO prior to adding to Oil E.

Figure 3:
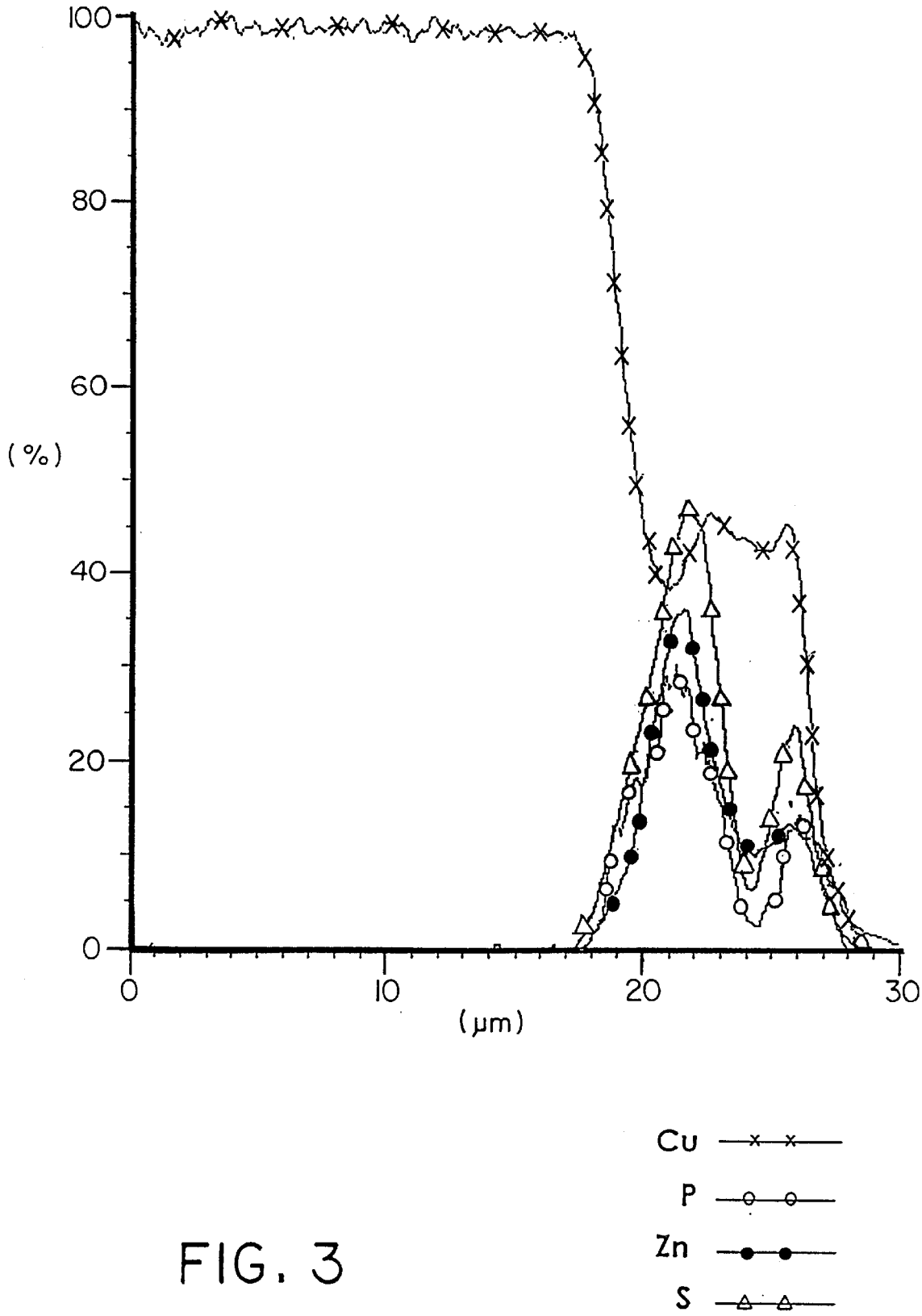
FIG. 3 shows EPMA (Electron Probe Microanalysis) of copper strips corroded in FIGS. 1 and 2 and demonstrate reduced copper content in corroded areas versus non-corroded areas and that in the corroded areas the concentration of sulfur is very high.

The copper plates used in the copper corrosion test in Oils C and E herein described above were further subjected to EPMA analysis. Photos revealed that the copper plate from Oil E was not corroded while that tested in Oil C was heavily corroded. A line analysis using EPMA was then conducted on the copper plate tested in Oil C. The results of the EPMA line analysis are shown in FIG. 3. FIG. 3 shows that at a given area of corrosion on the corroded copper plate that the copper content is greatly diminished compared to a non-corroded area. The Figure demonstrates that in areas of diminished copper content (corroded areas) the concentration of phosphorus, zinc and sulfur are very high. This result demonstrates the corrosive effects of zinc and phosphorus as well as sulfur. For a qualitative description of EPMA (Election Probe Microanalysis) see http://darkening.uoregon.edu/~mshaf/epmahome/index.html which is incorporated herein by reference.

What is claimed is:

1. A lubricating composition containing organomolybdenum compounds and having reduced copper corrosion properties; said composition comprising:

a mixture formed by mixing together
(A) a majority of an oil of lubricating viscosity;
(B) an organomolybdenum compound;
(C) a sulfur containing compound;
(D) a plant oil;

wherein (C) and (D) prior to addition to said mixture are mixed together and heated at time and temperature parameters sufficient to react the unbound sulfur of said sulfur containing compound with the plant oil.

2. A composition according to claim 1, wherein said (C) and (D) are heated together for about 3 hours at about 90° C. prior to mixing with (A) and (B).

3. A composition according to claim 1 or 2 wherein the weight ratio of (D) to (C) is 5:1 to 1:1.

4. A composition according to claim 1 or 2 wherein the weight ratio of (D) to (C) is less than 1:1 down to about 0.5:1.

5. An additive composition for use in a majority of an oil of lubricating viscosity, said composition comprising:

(A) an organomolybdenum compound;
(B) a sulfur containing compound;
(C) a plant oil;

wherein (B) and (C) prior to mixing with said organomolybdenum compound (A) are mixed together and heated at time and temperature parameters sufficient to react unbound sulfur of said sulfur containing compound with the plant oil wherein said oil containing said composition has reduced copper corrosion properties.

6. A composition according to claim 5, wherein (B) and (C) are heated together for about 3 hours at about 90° C. prior to mixing with (A).

7. A composition according to claim 5 or 6 wherein the weight ratio of (C) to (B) is 5:1 to 1:1.

8. A composition according to claim 5 or 6 wherein the weight ratio of C to B is less than 1:1 down to about 0.5:1.

* * * * *